US011746617B2

(12) United States Patent
Johansen

(10) Patent No.: US 11,746,617 B2
(45) Date of Patent: Sep. 5, 2023

(54) A-ANNULUS CEMENTING WITHOUT PUMPING CEMENT

(71) Applicant: Equinor Energy AS, Stavanger (NO)

(72) Inventor: Bård Marius Johansen, Ranheim (NO)

(73) Assignee: EQUINOR ENERGY AS, Stavanger (NO)

( * ) Notice: Subject to any disclaimer, the term of this patent is extended or adjusted under 35 U.S.C. 154(b) by 149 days.

(21) Appl. No.: 17/294,228

(22) PCT Filed: Nov. 6, 2019

(86) PCT No.: PCT/NO2019/050244

§ 371 (c)(1),
(2) Date: May 14, 2021

(87) PCT Pub. No.: WO2020/101503

PCT Pub. Date: May 22, 2020

(65) Prior Publication Data

US 2022/0003068 A1 Jan. 6, 2022

(30) Foreign Application Priority Data

Nov. 16, 2018 (GB) ..... 1818714

(51) Int. Cl.
*E21B 33/134* (2006.01)
*E21B 23/14* (2006.01)
*E21B 27/02* (2006.01)

(52) U.S. Cl.
CPC ..... *E21B 33/134* (2013.01); *E21B 23/14* (2013.01); *E21B 27/02* (2013.01)

(58) Field of Classification Search
CPC ..... E21B 33/134; E21B 23/14; E21B 27/02; E21B 33/12; E21B 33/13
See application file for complete search history.

(56) References Cited

U.S. PATENT DOCUMENTS

| | | | | |
|---|---|---|---|---|
| 2,189,445 A | | 2/1940 | Dale | |
| 2,653,666 A | | 9/1953 | Baker | |
| 3,231,020 A | * | 1/1966 | Greene, Jr. | E21B 33/134 166/195 |
| 3,556,215 A | * | 1/1971 | Owens | E21B 33/134 166/187 |
| 4,869,321 A | * | 9/1989 | Hamilton | E21B 29/10 166/309 |
| 2004/0188090 A1 | | 9/2004 | Vaeth et al. | |

(Continued)

FOREIGN PATENT DOCUMENTS

| | | |
|---|---|---|
| SU | 1364698 A1 | 1/1988 |
| WO | WO 2018/147745 A1 | 8/2018 |

OTHER PUBLICATIONS

International Search Report for PCT/NO2019/050244 dated Jan. 13, 2020.

(Continued)

*Primary Examiner* — Steven A MacDonald
(74) *Attorney, Agent, or Firm* — Birch, Stewart, Kolasch & Birch, LLP

(57) ABSTRACT

A method of plugging a well includes lowering a solid body into a wellbore by wireline; and filling the space around the solid body with a liquid plugging material. The solid body and the liquid plugging material together form a plug after the liquid plugging material is set.

17 Claims, 2 Drawing Sheets

(56) References Cited

U.S. PATENT DOCUMENTS

Figure 2C:
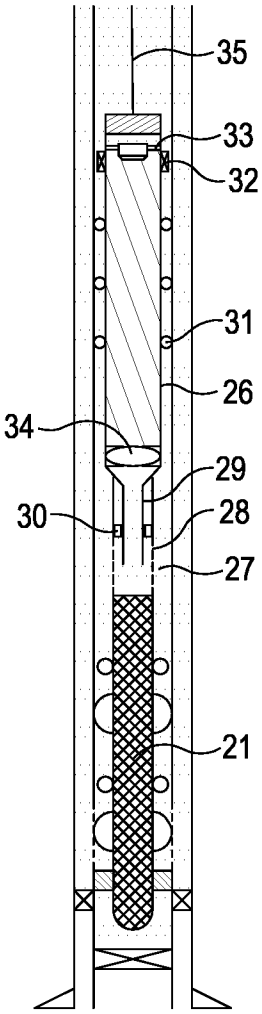

| | | | | |
|---|---|---|---|---|
| 2008/0047708 | A1 | 2/2008 | Spencer | |
| 2010/0006289 | A1* | 1/2010 | Spencer | E21B 36/04 166/292 |
| 2014/0318782 | A1* | 10/2014 | Bourque | E21B 27/02 166/177.4 |
| 2020/0032614 | A1* | 1/2020 | Usher | E21B 33/1204 |

OTHER PUBLICATIONS

United Kingdom Combined Search and Examination Report for Application No. GB1818714.6 dated Apr. 30, 2019.
United Kingdom Further Examination Report for Application No. GB1818714.6 dated Nov. 26, 2020.
Written Opinion of the International Searching Authority for PCT/NO2019/050244 dated Jan. 13, 2020.

* cited by examiner

A-ANNULUS CEMENTING WITHOUT PUMPING CEMENT

The invention relates to permanently plugging a hydrocarbon production well, and in particular to providing a cement plug in a production well above a production packer.

Wells used in gas and oil recovery need to be satisfactorily plugged and sealed after the wells have reached their end-of life and it is not economically feasible to keep the wells in service. Plugging of wells is performed in connection with permanent abandonment of wells due to decommissioning of fields or in connection with permanent abandonment of a section of well to construct a new wellbore with a new geological well target.

A well is constructed by a hole being drilled down into the reservoir using a drilling rig and then sections of steel pipe, casing or liner are placed in the hole to impart structural integrity to the wellbore. Cement can be placed between the outside of the casing or liner and the bore hole and then tubing is inserted into the casing to connect the wellbore to the surface. Once the reservoir has been abandoned, a permanent well barrier must be established across the full cross-section of the well. This is generally achieved by removal of the inner tubulars from the well bore by means of a workover rig which pulls the tubulars to the surface. Well barriers are then established across the full cross-section of the well, in order to isolate the reservoir(s) and prevent flow of formation fluids between reservoirs or to the surface. Improperly abandoned wells are a serious liability so it is important to ensure that the well is adequately plugged and sealed. However, the number of steps and equipment involved, such as a rig and drillpipe, results in this stage of the life of the well being costly and time-consuming, at a time when the well no longer generates revenue. When a production tubing is left in place, cement can be pumped into the tubing and annulus around the production tubing which forms a plug once it is set. However, further equipment is required for pumping cement, and it would be preferable to use wireline tools at all stages of the process, including cementing.

U.S. Pat. No. 2,189,445 discloses the use of a combination plug and dump bailer. US 2004/0188090 discloses a method to increase the bonding forces of a hydraulic cement to a subterranean pipe by the addition of an expansive agent.

According to a first aspect of the invention there is provided a method of plugging a well, the method comprising the following steps: lowering a solid body into a wellbore by wireline; filling the space around the solid body with a liquid plugging material; and wherein the solid body and the liquid plugging material together form a plug after the liquid plugging material is set.

The solid body may comprise pre-set cement. The liquid plugging material may be non-set cement, which, optionally may also be lowered into the wellbore by wireline.

The volume of the solid body is at least 20% or, alternatively, at least 50% of the volume of the plug.

The well may comprises a tubing and a seal provided in an annulus between the tubing and a casing, and the method may further comprise the following steps prior to steps a) and b): c) arranging a lower seal within the tubing, wherein the lower seal forms a liquid tight seal between the bore of the tubing above the lower seal and the bore of the production tubing below the lower seal; d) forming holes in the production tubing above the lower seal and the seal; e) providing a fluid in the production tubing and in the annulus above the lower seal and the seal.

The tubing may be production tubing and the seal may be a production packer.

Optionally, step a) further comprises providing a supporting connection between the production tubing and the solid body to fix the position of the solid body within the production tubing; and removing the wireline.

Optionally, step b) comprises lowering a container with a liquid plugging material by wireline and releasing the liquid plugging material from the container into the space around the solid body. The step of releasing may comprise the following steps: providing a pressure-tight seal in an annulus between the container and the production tubing; increasing pressure above the container to move a bung provided at the top of the container and to burst a seal at the lower end of the container, thereby ejecting the non-set cement from the container.

According to a second aspect of the invention, there is provided an assembly for plugging a well, the assembly comprising: a solid body; a container for containing and releasing a liquid plugging material; wherein the solid body and the container are in use lowered into a tubular by wireline, wherein a plug can be formed by the solid body together with the liquid plugging material after the liquid plugging material is set.

The solid body may comprise a sleeve extending upwards for supporting the container, and wherein the container comprises a funnel which can be received by the sleeve.

The container may comprise a bung and a seal which close the container, wherein the seal is arranged to burst under a predetermined pressure.

The solid body and the container may each comprise expandable packers for setting the solid body and the container against the production tubular.

Figure 2B:
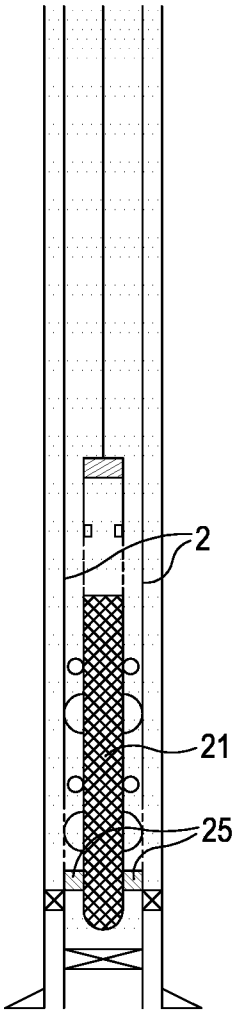
Figure 2A:
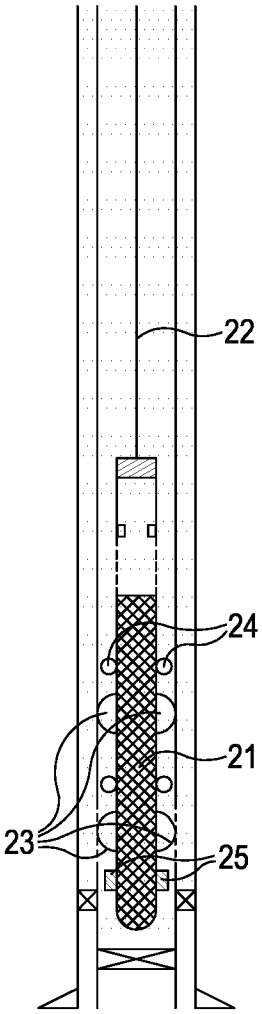
Figure 1C:
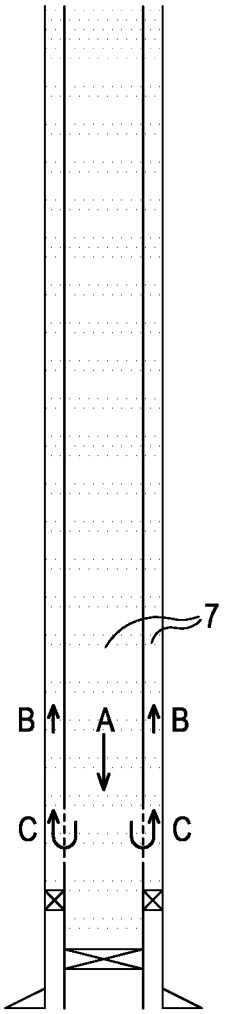
Figure 1B:
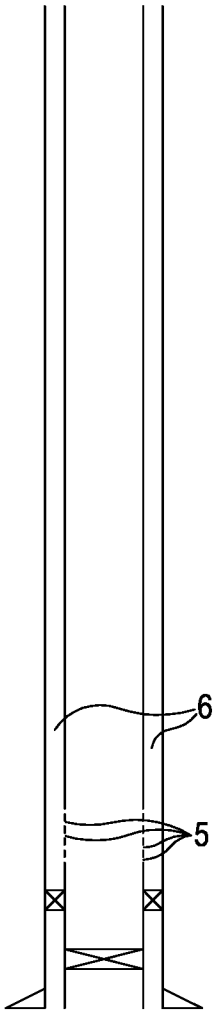
Figure 1A:
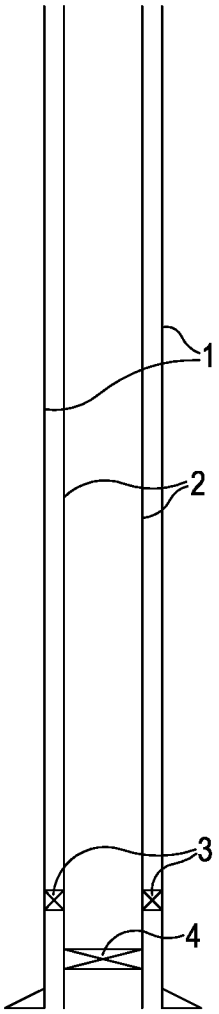
Figures 3A, 3B, 3C, 4A, 4B, 4C:
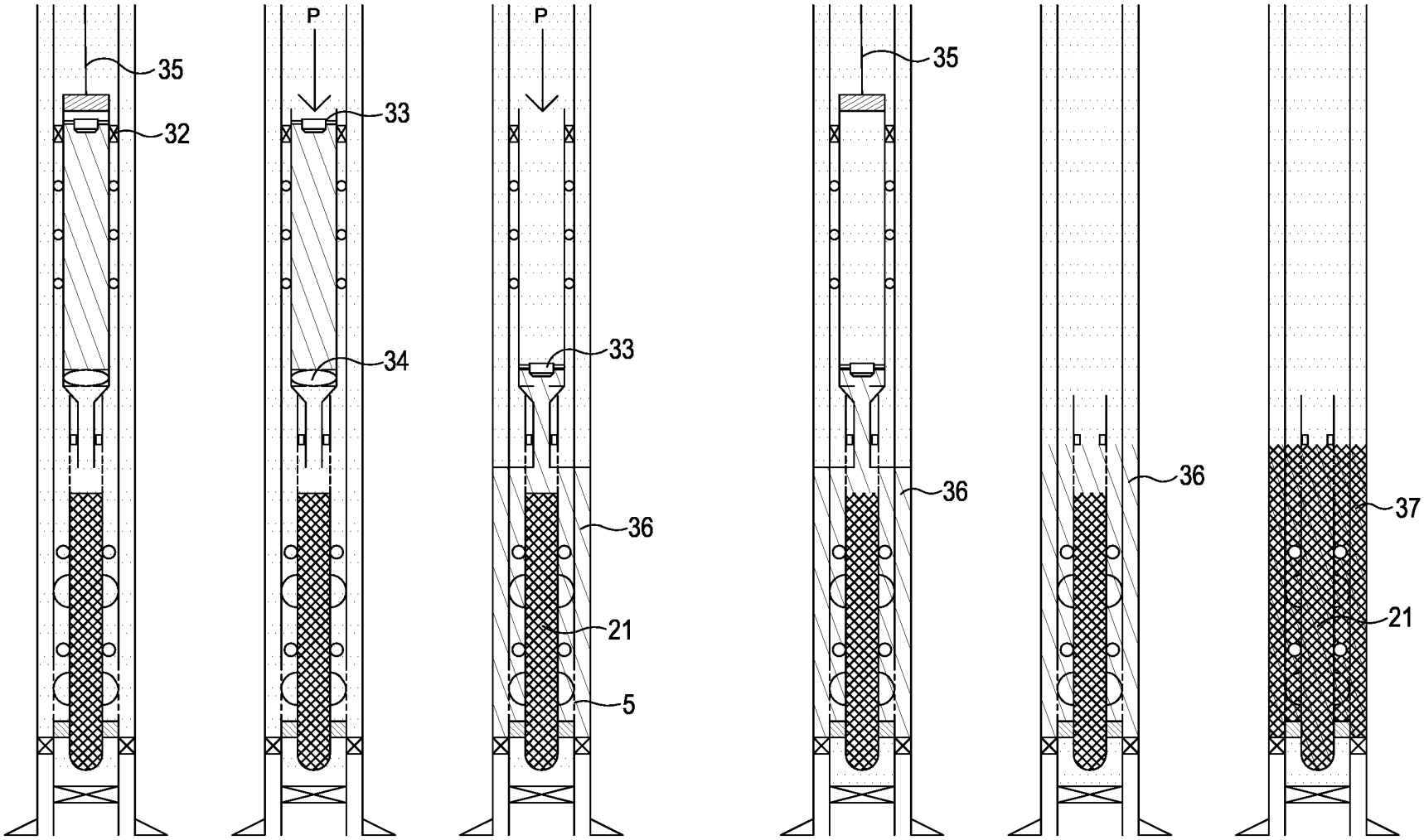

Some embodiments of the invention will now be described by way of example only and with reference to the accompanying drawings, in which:

FIGS. 1*a* to 1*c* illustrate a well during different stages of a method, FIGS. 2*a* to 2*c* illustrate a well during different stages of a method, FIGS. 3*a* to 3*c* illustrate a well during different stages of a method, and FIGS. 4*a* to 4*c* illustrate a well during different stages of a method.

The inventors have realised that a pre-set solid body of cement can be lowered into the production tubing and set in an area where the plug will subsequently be formed. The pre-set cement body is produced at the surface under well-controlled conditions and the integrity of the cement body is tested before the cement body is lowered into the wellbore. The area around the cement body is then filled up with non-set cement which together with the cement body forms the plug. The cement body forms a substantial part of the plug, in some cases the majority of the plug, and the known integrity of the cement body therefore improves the overall integrity of the plug. Moreover, a smaller amount of additional non-set cement will be required when compared to a method without the pre-set cement body, which in turn enables the non-set cement to be provided by way of a container. The container can be lowered to the site of the plug with wireline and the entire process can thus be carried out by wireline.

Other materials than cement can be used for preparing the solid body. For example, bismuth can be used or other metals or metal alloys. The material needs to be suitable for permanently plugging a well. A specific example of a solid body is a metal pipe closed at the bottom end which is filled with cement, and a hook is cast into the cement for attaching the body to a wireline. The dimensions of the plug may be limited by the maximum weight which can be carried by a wireline cable.

It is possible to use multiple solid bodies, in which case the previously described process is repeated one or more times.

A specific embodiment of the method is illustrated in FIGS. 1*a* to 4*c* which illustrate subsequent steps of the method. FIG. 1*a* illustrates a production casing 1 and within the production casing a production tubular 2 is provided. A production packer 3 is provided within an annulus between production casing 1 and production tubular 2. As a first step in the specific embodiment, a liquid-tight seal 4 is formed within the production tubular. A specific example of the liquid-tight seal is a mechanical bridge plug. The seal 4 is set just below the production packer in the illustrated example, but can also be set slightly higher or lower. The seal not only supports the plug before non-set cement is set, but also reduces the volume of cement which is required to form a plug when compared to a setup without the seal.

A production packer 3 is illustrated as a base which provides a lower seal within the annulus to prevent liquid cement or cleaning fluid flowing from flowing downwards within the annulus. However, other seals can be provided within the annulus, examples are a mechanical packer, an epoxy base within the annulus, or a bismuth plug. Descriptions or definitions including the expression 'production packer' can therefore be generalised to a 'base' within the annulus. The production tubing is also not a limiting example, and a more general definition of a tubing or tubular can also be used instead.

A first alternative example of a base in the annulus is an epoxy base. First, a base is set within the production tubing, for example a mechanical plug. Next, holes are formed in the production tubing for access to the annulus. An epoxy is finally pushed into the annulus through the holes.

A second alternative example of a base is a bismuth plug. Again, holes need to be formed in the tubing for access to the formation. The bismuth plug is placed across the entire internal space, including the tubing and annulus. In this example, the base within the tubing and the base within the annulus are provided by a single plug.

FIG. 1*b* illustrates the next step of the process. A plurality of openings 5 are formed in the production tubular 2 to provide a fluid path from the bore of the production tubular to the annulus 6. The openings can be formed with any conventional means, such as explosives, or mechanical or hydraulic hole punching devices. FIG. 1*c* illustrates how the tubular and the annulus are filled with a fluid 7, for example water or brine. The fluid can be circulated into the bore of the tubular down, through the openings 5 and back up through the annulus. Arrow A illustrates the fluid flow downwards and arrows B illustrates the fluid flow back up, while arrows C illustrate the flow through the openings 5. The fluid can therefore be circulated to clean the area in which the plug will be formed. The circulation path is also used for getting non-set cement in the annulus in a later step. The circulation of fluid can also take place the opposite way, whereby the fluid flows down through the A-annulus and back up through the production tubing.

FIG. 2*a* illustrates a solid concrete body 21 lowered into the wellbore by way of wireline 22. The body 21 is centralised by way of mechanical centralisers 23. Specific examples of centralises 23 are metal bow-string centralisers which are folded up until they are ready to be deployed and which are released when the body is in place to centralise the body. As illustrated in FIG. 2*a*, the body occupies more than half of the cross section of the production tubular and has a cylindrical shape such that it extends over a much longer longitudinal distance of the tubular than it extends in radial direction. Elements 24 are guiding elements which centralise the body while it is lowered down into the tubular and elements 24 can, for example, include wheels, rollers, or simple spacers such as solid pieces of material. Body 21 is set against the inside wall of the production tubular with expandable devices 25, for example swell packers which are activated with brine. The swell packers can optionally seal the space around the solid body such that the volume of the plug is reduced by closing the portion of the tubular below the swell packers. FIG. 2*b* illustrate devices 25 set against the production tubular 2 and the body 21 is now in a fixed position at the desired depth and centralised within the production tubular. The centralisers 23, elements 24 and devices 25 do not extend around the entire circumference of the body to avoid blocking the flow of fluids around the body.

FIG. 2*c* illustrates the next step of a container 26 with non-set cement having been lowered to just above body 21. In the illustrated embodiment, the body 21 includes a collar 27 extending upwards and body 21 can rest on collar 27. The positioning of the container does therefore not need to be determined precisely from the surface, but the container can instead be lowered until it makes contact with the collar 27. The collar 27 has openings 28 so as to provide a fluid path for the non-set cement. The lower part of the container includes a funnel 29 which is received by collar 27. Spacers 30 help to keep the funnel in place. Guiding elements 31 are provided on the outside of the container to centralise the container within the tubular. A straddle packer 32 is provided which can be expanded against the tubular, as illustrated in the next FIG. 3*a*, to keep the container in place. A bung 33 is provided at the top of the container. The bung closes the container from the top and can move through the container because the container has a cylindrical bore through which the bung can travel. The bung drives the non-set cement out of the container under pressure. A seal 34 is provided within the container at the lower end above the funnel 29. The seal prevents the non-set cement from leaving the container through the funnel. Seal 34 can be burst under pressure. The container is lowered by wireline 35. An alternative embodiment to the one illustrated with a pressure-activated release of cement is an electrical piston which ejects the cement. Either way, the amount of non-set cement which is ejected is controlled and is predetermined and therefore the dimensions of the final plug will be known. The packer 32 not only keeps the container in place, but also seals the space around the container such that when the ejection is pressure activated the bung is pushed downwards. The packer 32 also ensures that the cement is forced into the annulus when pressure is applied.

FIG. 3*a* illustrates how packer 32 is expanded. The container has been set in the arrangement of FIG. 3*a* and the wireline 35 can be removed. FIG. 3*b* illustrates the wireline removed. The fluid pressure above the container is now increased as illustrated by arrow P. The bung 33 will start moving downwards which increases the pressure within the container and the pressure on seal 34. As illustrated in FIG. 3*c*, seal 34 has burst due to the pressure and bung 33 has moved downwards towards the funnel, driving the non-set cement out of the container, around body 21, through openings 5 and upwards into the annulus. The entire cross sectional area of the production tubing and A-annulus has now been filled with a combination of the pre-set cement body and the non-set cement 36.

FIG. 4*a* illustrates the additional pressure having been removed and wireline 35 being brought back in to remove the now empty container. FIG. 4*b* illustrates the container removed and the non-set cement 36 being in place. FIG. 4*c* illustrates the final stage in which the non-set cement has set and has formed a single plug 37 with integrally formed body 21.

The set plug can be pressure tested by conventional means, such as by applying a heavy load onto the top of the plug, or other methods of testing the integrity of the plug.

The area outside the outer casing is sometimes referred to as 'B-annulus'. The B-annulus may be filled with cement, formation, collapsed formation, or also contain cavities. Even if the plug itself satisfies safety requirements and prevents any leaks, there may be leaks via the B-annulus. Therefore, the B-annulus also needs to be tested for any leaks.

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. A method of plugging a well, the method comprising the following steps:

a) lowering a solid body into a wellbore by wireline; and b) filling the space around the solid body with a liquid plugging material, wherein the solid body and the liquid plugging material together form a plug after the liquid plugging material is set, and wherein the solid body comprises pre-set cement.

2. The method of claim 1, wherein the liquid plugging material is non-set cement.

3. The method of claim 2, wherein the non-set cement is lowered into the wellbore by wireline.

4. The method of claim 1, wherein the volume of the solid body is at least 20% of the volume of the plug.

5. The method of claim 1, wherein the volume of the solid body is at least 50% of the volume of the plug.

6. The method of claim 1, wherein the well comprises a tubing and a seal provided in an annulus between the tubing and a casing, and wherein the method further comprises the following steps prior to the steps a) and b):

c) arranging a lower seal within the tubing, wherein the lower seal forms a liquid tight seal between the bore of the tubing above the lower seal and the bore of the tubing below the lower seal;

d) forming holes in the tubing above the lower seal and the seal; and e) providing a fluid in the tubing and in the annulus above the lower seal and the seal.

7. The method of claim 6, wherein the tubing is a production tubing.

8. The method of claim 7, wherein the step a) further comprises:

providing a supporting connection between the production tubing and the solid body to fix the position of the solid body within the production tubing; and removing the wireline.

9. The method of claim 7, wherein the step b) further comprises lowering a container with a liquid plugging material by wireline and releasing the liquid plugging material from the container into the space around the solid body.

10. The method of claim 9, wherein said releasing comprises the following steps:

providing a pressure-tight seal in an annulus between the container and the production tubing; and increasing pressure above the container to move a bung provided at the top of the container and to burst a seal at the lower end of the container, thereby ejecting the non-set cement from the container.

11. The method of claim 6, wherein the seal is a production packer.

12. The method of claim 1, wherein the solid body and the liquid plugging material overlap with each other in a direction orthogonal to a longitudinal axis of the wellbore.

13. An assembly for plugging a well, the assembly comprising:

a solid body; and a container for containing and releasing a liquid plugging material, wherein the solid body and the container are configured to be lowered into a tubular by wireline, and wherein a plug is configured to be formed by the solid body together with the liquid plugging material after the liquid plugging material is set around the solid body, and wherein the solid body comprises pre-set cement.

14. The assembly of claim 13, wherein the solid body comprises a sleeve extending upwards for supporting the container, and wherein the container comprises a funnel which can be received by the sleeve.

15. The assembly of claim 13, wherein the container comprises a bung and a seal which close the container, wherein the seal is arranged to burst under a predetermined pressure.

16. The assembly of claim 13, wherein the solid body and the container each comprise expandable packers for setting the solid body and the container against the tubular.

17. The assembly of claim 13, wherein the plug is configured to be formed in such a manner that the solid body and the liquid plugging material overlap with each other in a direction orthogonal to a longitudinal axis of the tubular.

* * * * *